US010967412B2

(12) United States Patent
Mitchell et al.

(10) Patent No.: US 10,967,412 B2
(45) Date of Patent: Apr. 6, 2021

(54) END CLOSURE WITH COINED PANEL RADIUS AND REFORM STEP

(71) Applicant: STOLLE MACHINERY COMPANY, LLC, Centennial, CO (US)

(72) Inventors: Mark Richard Mitchell, Sidney, OH (US); Aaron Emmanuel Carstens, Centerville, OH (US); Craig Allen McEldowney, Russia, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 51 days.

(21) Appl. No.: 15/799,199

(22) Filed: Oct. 31, 2017

(65) Prior Publication Data

US 2018/0050379 A1 Feb. 22, 2018

Related U.S. Application Data

(62) Division of application No. 14/055,965, filed on Oct. 17, 2013, now abandoned.
(Continued)

(51) Int. Cl.
*B21D 22/20* (2006.01)
*B65D 17/28* (2006.01)
(Continued)

(52) U.S. Cl.
CPC ..... *B21D 22/20* (2013.01); *B21D 22/24* (2013.01); *B21D 22/30* (2013.01); *B21D 51/44* (2013.01);
(Continued)

(58) Field of Classification Search
CPC ..... B21D 22/20; B21D 22/30; B21D 22/24; B21D 51/44; B21D 51/38; B21D 51/383;
(Continued)

(56) References Cited

U.S. PATENT DOCUMENTS 3,326,405 A 6/1967 Fraze
3,417,898 A 12/1968 Bozek et al.
(Continued)

FOREIGN PATENT DOCUMENTS

DE 29906170 U1 9/1999
EP 0103074 A2 3/1984
(Continued)

OTHER PUBLICATIONS

English translate (JP2008264880A), retrieved date Jul. 2, 2019.*
(Continued)

*Primary Examiner* — Adam J Eiseman
*Assistant Examiner* — Mohammed S. Alawadi
(74) *Attorney, Agent, or Firm* — Eckert Seamans Cherin & Mellott, LLC

(57) ABSTRACT

A method of forming a can end shell is provided which includes providing a can end shell having a central panel portion, a first panel radius around the central panel portion, a chamfer extending from the first panel radius, and a second panel radius around the chamfer, coining the can end shell to form a coined section in the first panel radius around at least a portion of the circumference of the central panel portion, and reforming the can end shell to form a step in the chamfer.

11 Claims, 8 Drawing Sheets

Related U.S. Application Data

(60) Provisional application No. 61/715,461, filed on Oct. 18, 2012.

(51) Int. Cl.
*B21D 22/30* (2006.01)
*B21D 51/44* (2006.01)
*B21D 22/24* (2006.01)

(52) U.S. Cl.
CPC .. *B65D 17/4012* (2018.01); *B65D 2517/0014* (2013.01); *B65D 2517/0062* (2013.01); *B65D 2517/0082* (2013.01)

(58) Field of Classification Search
CPC ..... B21D 22/22; B65D 17/4012; B65D 2517/0082; B65D 2517/0062; B65D 2517/0014
USPC ..... 72/379.4
See application file for complete search history.

(56) References Cited

U.S. PATENT DOCUMENTS

| | | | | |
|---|---|---|---|---|
| 3,441,170 | A | | 4/1969 | Khoury |
| 3,554,400 | A | | 1/1971 | Bozek |
| 3,638,825 | A | | 2/1972 | Franek et al. |
| 3,774,801 | A | | 11/1973 | Gedde |
| 4,031,837 | A | | 6/1977 | Jordan |
| 4,093,102 | A | | 6/1978 | Kraska |
| 4,434,641 | A | | 3/1984 | Nguyen |
| 4,571,978 | A | | 2/1986 | Taube et al. |
| 4,577,774 | A | | 3/1986 | Nguyen |
| 4,641,761 | A | | 2/1987 | Smith et al. |
| 4,704,887 | A | | 11/1987 | Bachmann et al. |
| 4,796,772 | A | | 1/1989 | Nguyen |
| 4,832,223 | A | | 5/1989 | Kalenak et al. |
| 5,149,238 | A | * | 9/1992 | McEldowney ..... B21D 51/44 413/8 |
| 5,356,256 | A | | 10/1994 | Turner et al. |
| 2003/0075544 | A1 | | 4/2003 | Turner et al. |
| 2005/0252922 | A1 | | 11/2005 | Reed et al. |
| 2010/0059517 | A1 | | 3/2010 | An |
| 2013/0299496 | A1 | * | 11/2013 | Forrest ..... B65D 17/4012 220/269 |

FOREIGN PATENT DOCUMENTS

| | | | | |
|---|---|---|---|---|
| EP | 0497346 | A1 | | 8/1992 |
| JP | 2008264880 | A | * | 11/2008 |
| JP | 2008264880 | A2 | | 11/2008 |

OTHER PUBLICATIONS

European Patent Office, "Extended European Search Report", European Patent Application No. 13846676.7, dated May 24, 2016, 9 pp.
Stolle Machinery Company, LLC, EP20152507.8 Search Report, dated Apr. 3, 2020, 7 pages.

* cited by examiner

END CLOSURE WITH COINED PANEL RADIUS AND REFORM STEP

CROSS-REFERENCE TO RELATED APPLICATION

This patent application claims the priority benefit under 35 U.S.C. § 119(e) of U.S. Utility patent application Ser. No. 14/055,965 filed on Oct. 17, 2013, and entitled, "END CLOSURE WITH COINED PANEL RADIUS AND REFORM STEP"; and U.S. Provisional Application No. 61/715,461 filed on Oct. 18, 2012, and entitled, "END CLOSURE WITH COINED PANEL RADIUS AND REFORM STEP," the contents of which are hereby incorporated herein by reference.

BACKGROUND

Field

The disclosed concept relates generally to containers and, more particularly, to can ends or shells for metal containers such as, for example, beer or beverage cans, as well as food cans. The disclosed concept also relates to methods and tooling for selectively forming a can end or shell to reduce the amount of material used therein.

Background Information

Metallic containers (e.g., cans) for holding products such as, for example, food and beverages, are typically provided with an easy open can end on which a pull tab is attached (e.g., without limitation, riveted) to a tear strip or severable panel. The severable panel is defined by a scoreline in the exterior surface (e.g., public side) of the can end. The pull tab is structured to be lifted and/or pulled to sever the scoreline and deflect and/or remove the severable panel, thereby creating an opening for dispensing the contents of the can.

When the can end is made, it originates as a can end shell, which is formed from a sheet metal product (e.g., without limitation, sheet aluminum; sheet steel). The shell is then conveyed to a conversion press, which has a number of successive tool stations. As the shell advances from one tool station to the next, conversion operations such as, for example and without limitation, rivet forming, paneling, scoring, embossing, tab securing and tab staking, are performed until the shell is fully converted into the desired can end and is discharged from the press.

In the can making industry, large volumes of metal are required in order to manufacture a considerable number of cans. Thus, an ongoing objective in the industry is to reduce the amount of metal that is consumed. Efforts are constantly being made, therefore, to reduce the thickness or gauge (sometimes referred to as "down-gauging") of the stock material from which can ends and can bodies are made. However, as less material (e.g., thinner gauge) is used, problems arise that require the development of unique solutions. Thus, there is a constant desire in the industry to reduce the gauge, and thus the amount, of material used to form such containers. However, among other disadvantages associated with the formation of can ends from relatively thin gauge material, is the tendency of the can end to wrinkle, for example, due to pressure produced from the from the product contained in the can to which the can end is attached, such as pressure produced from a carbonated beverage or pressures that result from the sterilization or pasteurization processes involved in food and/or beverage applications.

There is, therefore, room for improvement in containers such as beer/beverage cans and food cans, as well as in selectively formed can ends or shells and tooling and methods for providing such can ends or shells.

SUMMARY

These needs and others are met by embodiments of the disclosed concept, which are directed to a method of forming a can end shell, a tool assembly to reform a can end shell, and a can end shell.

As one aspect of the disclosed concept, a method of forming a can end shell includes providing a can end shell having a central panel portion, a first panel radius around the central panel portion, a chamfer extending from the first panel radius, and a second panel radius around the chamfer, coining the can end shell to form a coined section in the first panel radius around at least a portion of the circumference of the central panel portion, and reforming the can end shell to form a step in the chamfer.

As another aspect of the disclosed concept, a tool assembly is provided to reform a can end shell having a central panel portion, a first panel radius around the central panel portion, a chamfer extending from the first panel radius, and a second panel radius around the chamfer. The tooling assembly includes a coining tool assembly including a coining tool having an angled section structured to form a coined section in the first panel radius around at least a portion of the circumference of the central panel portion during a coining operation, and a reforming tool assembly including a reforming tool having a reforming section structured to form a step in the chamfer during a reforming operation.

As another aspect of the disclosed concept, a can end shell includes a central panel portion, a first panel radius around the central panel portion, a chamfer extending from the first panel radius, a second panel radius around the chamfer, a coined section formed in the first panel radius around at least a portion of the circumference of the central panel portion, and a step formed in the chamfer.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
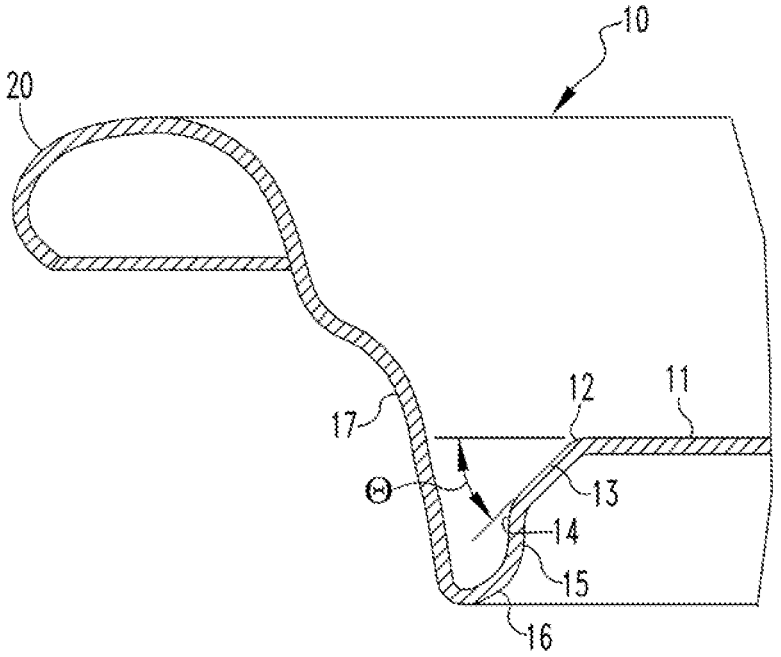
FIG. 1 is an enlarged side section view of a portion of a can end shell prior to being reformed in accordance with the disclosed concept.

For purposes of illustration, embodiments of the disclosed concept will be described as applied to shells, although it will become apparent that they could also be employed to suitably strengthen the panel portion of any known or suitable can end (e.g., without limitation, beverage/beer can ends; food can ends).

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, left, right, front, back, top, bottom, upper, lower and derivatives thereof, relate to the orientation of the elements shown in the drawings and are not limiting upon the claims unless expressly recited therein.

As employed herein, the terms "can" and "container" are used substantially interchangeably to refer to any known or suitable container, which is structured to contain a substance (e.g., without limitation, liquid; food; any other suitable substance), and expressly includes, but is not limited to, beverage cans, such as beer and soda cans, as well as food cans.

As employed herein, the term "can end" refers to the lid or closure that is structured to be coupled to a can, in order to seal the can.

As employed herein, the term "can end shell" is used substantially interchangeably with the term "can end." The "can end shell" or simply the "shell" is the member that is acted upon and is converted by the disclosed tooling to provide the desired can end.

As employed herein, the statement that two or more parts are "coupled" together shall mean that the parts are joined together either directly or joined through one or more intermediate parts.

As employed herein, the term "number" shall mean one or an integer greater than one (i.e., a plurality).

FIG. 1 shows an enlarged section view of a portion of a can end shell 10 before being reformed in accordance with one non-limiting embodiment of the disclosed concept. The can end shell 10 has a substantially planar central panel portion 11, a first panel radius 12 around the central panel portion 11, a chamfer 13 extending from the first panel radius 12, and a second panel radius 14 around the chamfer 13. The can end shell 10 also has a panel wall 15 extending downwardly from the second panel radius 14, a countersink 16 around the panel wall 15, a chuckwall 17 extending upwardly from the countersink 16, and a curved flange 20 around the chuckwall 17 for double seaming or otherwise attaching the can end shell 10 to a can or other container after it has been converted into a finished can end.

The can end shell 10 has an interior surface adapted for exposure to the contents of the container and an exterior surface for exposure to the environment. The can end shell 10 can be formed, for example and without limitation, of sheet metal such as an aluminum alloy. In one non-limiting embodiment, an aluminum alloy is used to form the can end shell 10 and the gauge of the aluminum alloy is in a range of, for example and without limitation, about 0.0082 to about 0.013 inches. It will be appreciated, however, that the disclosed concept can be employed with any known or suitable gauge of material with respect to any known or suitable type and/or configuration of shell or can end. The can end shell 10 may also be formed of any other suitable materials such as steel, tinplate, polymer-aluminum laminates, and composite materials without departing from the scope of the disclosed concept.

The chamfer 13 is formed at an angle θ with respect to the central panel portion 11. In one non-limiting embodiment, the angle θ is about 45°. In another non-limiting embodiment, the angle θ is within a range of about 30° to about 60°. However, it is appreciated that the angle θ can have any value without departing from the scope of the disclosed concept.

Figure 2:
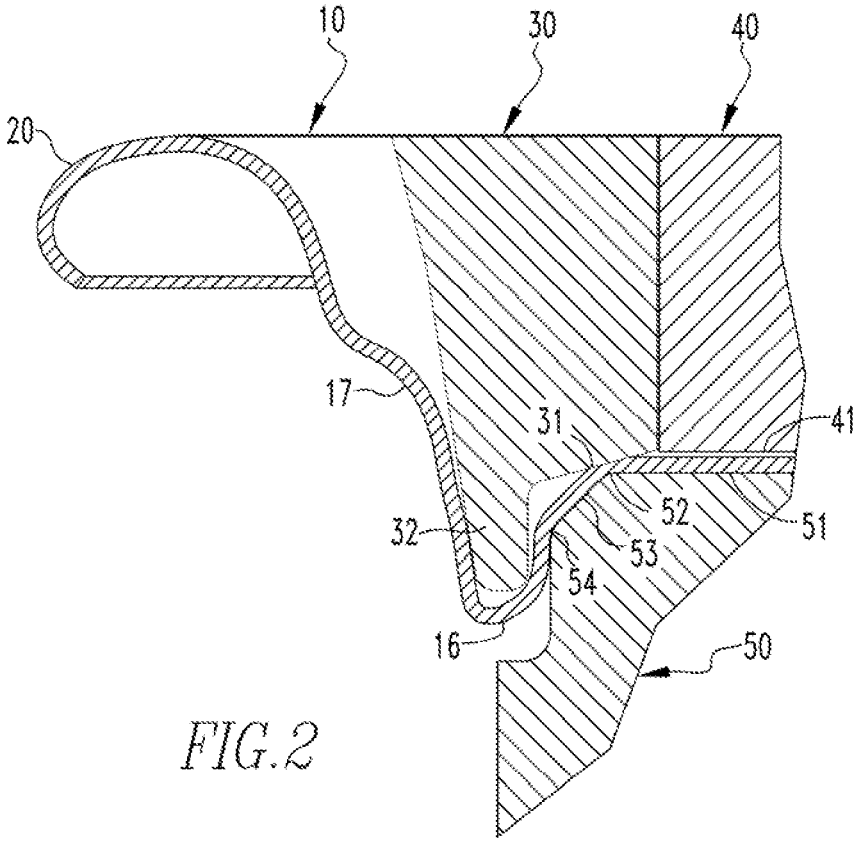
FIG. 2 is an enlarged side section view of a portion of the can end shell as it is being coined in accordance with an embodiment of the disclosed concept.
Figure 3:
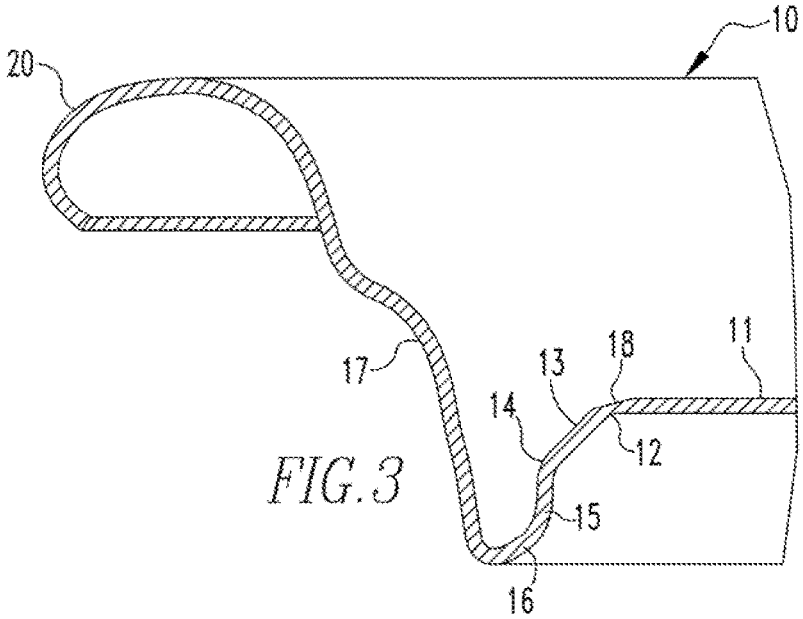
FIG. 3 is an enlarged side section view of a portion of the can end shell after it has been coined in accordance with an embodiment of the disclosed concept.

FIG. 2 shows an enlarged side section view of a portion of the can end shell 10 as it is being coined by a coining tool assembly in accordance with one non-limiting embodiment of the disclosed concept, and FIG. 3 shows the can end shell 10 after it has been coined. The tools for coining the can end shell 10 include a coining tool 30 and a coining support assembly including an upper coining support tool 40 and a lower coining support tool 50. While two upper tools and one lower tool are illustrated in FIG. 2, it is contemplated that any number of tools may be employed without departing from the scope of the disclosed concept. For example and without limitation, the coining tool 30 and the upper coining support tool 40 may be integrally formed as a single tool or split into any number of tools. Similarly, the lower coining support tool 50 may be split into any number of tools.

The coining tool 30 has an angled section 31 that, when pressed against the can end shell 10 in the coining operation shown in FIG. 2, causes a coined section 18 (see FIG. 3) to be formed in the first panel radius 12 around at least a portion of the circumference of the central panel portion 11. The coined section 18 may also be formed in the first panel radius 12 around the entire circumference of the central panel portion 11 without departing from the scope of the disclosed concept.

The coining tool 30 further includes a first elongated portion 32. The first elongated portion 32 is structured to be seated in the countersink 16 during the coining operation shown in FIG. 2. In some embodiments the first elongated portion 32 may also be used to reform the can end shell 10, for example and without limitation, to deepen the countersink 16 and/or modify the shape of the panel wall 15 and/or chuckwall 17, for example by making it substantially vertical.

The upper coining support tool 40 and lower coining support tool 50 support the can end shell 10 while it is being coined. That is, the upper coining support tool 40 includes a first flat portion 41 that is structured to abut against an upper side of the central panel portion 11 during the coining operation shown in FIG. 2. Similarly, the lower coining support tool 50 includes a second flat portion 51 that is structured to abut against a lower side of the central panel portion 11 during the coining operation shown in FIG. 2. The lower coining support tool 50 also includes a first curved portion 52, a chamfered portion 53, and a second curved portion 54 which are structured to conform to the bottom sides of the first panel radius 12, chamfer 13, and second panel radius 14, respectively, thus supporting the lower side of the can end shell 10 during the coining operation shown in FIG. 2.

In the coining operation, the can end shell 10 may be carried from station to station by a belt in a manner well known in the art. The belt (not shown) carries the can end shell 10 to the coining tool assembly shown in FIG. 2. The upper and lower coining support tools 40 and 50 are closed on the can end shell 10 to support the can end shell 10 while the coining tool 30 is pressed against the can end shell 10, as shown in FIG. 2, to form the coined section 18 in the first panel radius 12. The can end shell 10 including the coined section 18 is shown in FIG. 3.

Coining the first panel radius 12 cold works the metal in the coined area and thereby strengthens the first panel radius 12, which in turn makes the can end shell 10 more resistant to buckling, for example, from pressure within the container to which the can end shell 10 is eventually attached. Coining the first panel radius 12 also produces increased surface area of metal in the can end shell 10. However, coining the first panel radius 12 also produces loose or slack metal, which is undesirable.

Figure 4:
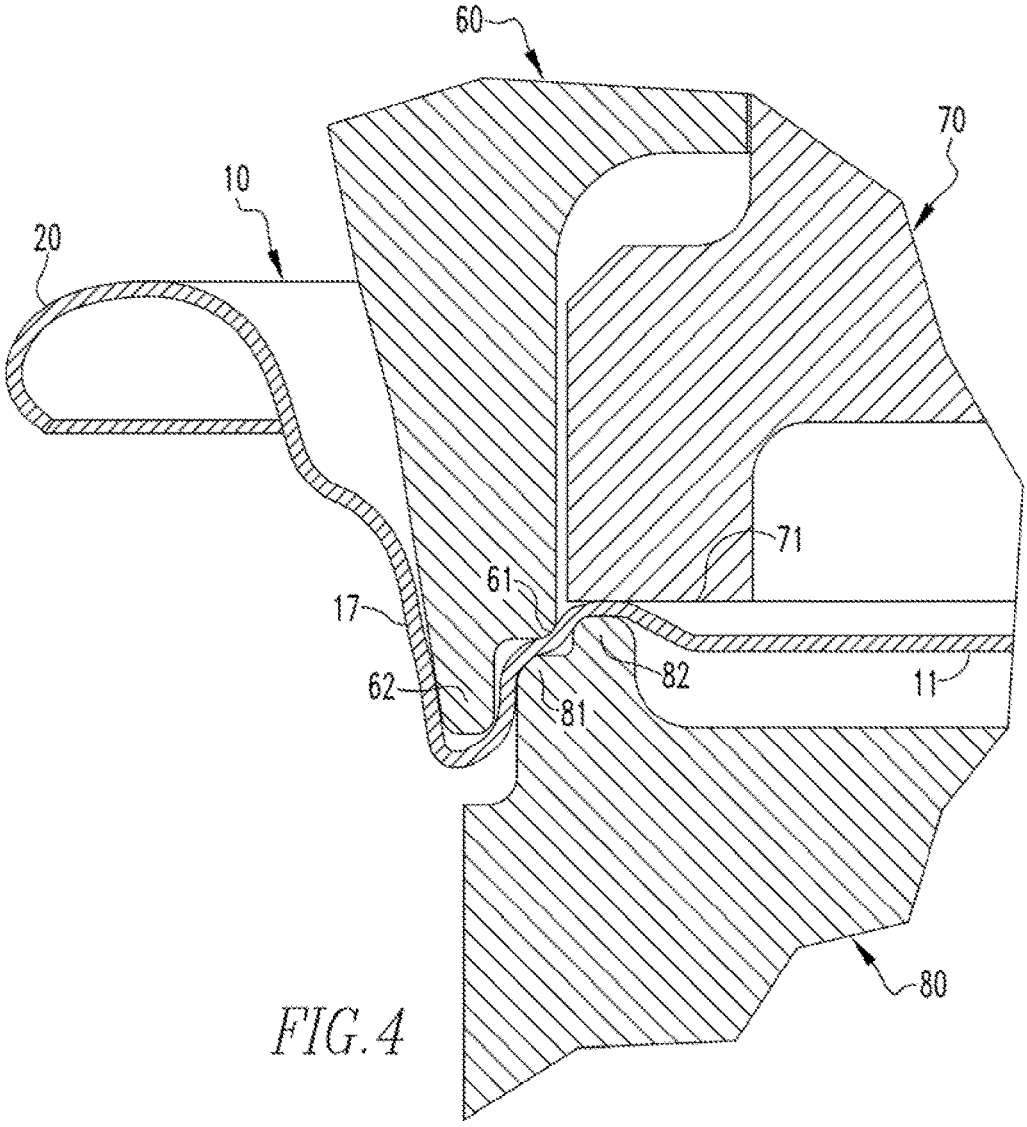
FIG. 4 is an enlarged side section view of a portion of the can end shell as it is being reformed in accordance with an embodiment of the disclosed concept.
Figure 5:
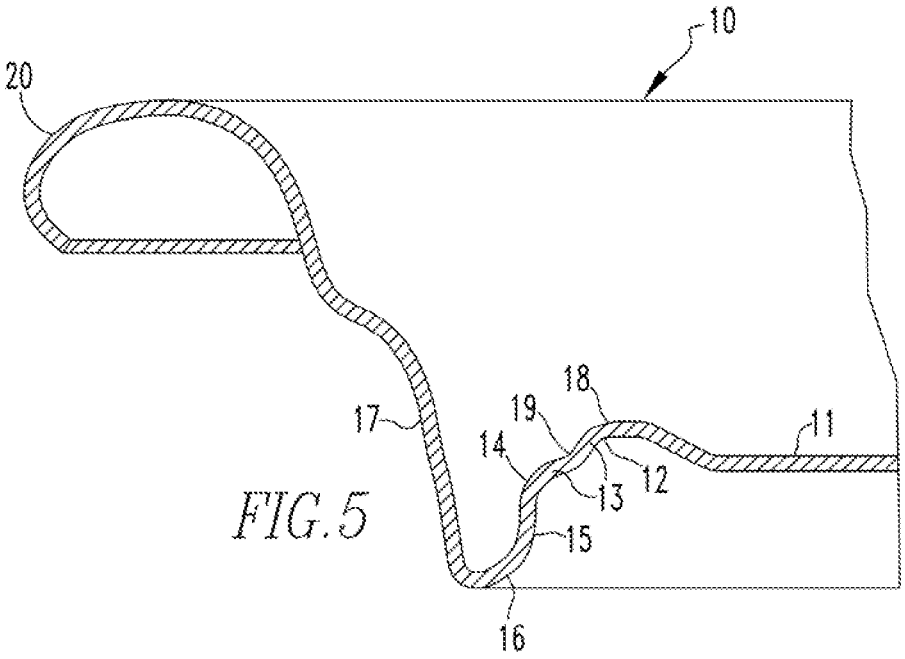
FIG. 5 is an enlarged side section view of a portion of the can end shell after it has been reformed in accordance with an embodiment of the disclosed concept.

FIG. 4 is an enlarged side section view of a portion of the can end as it is being reformed in accordance with one non-limiting embodiment of the disclosed concept, and FIG. 5 shows the can end shell 10 after it has been reformed.

After the coining operation, the can end shell 10 is transferred to a reforming tool assembly, as illustrated in FIG. 4, to reform the can end shell 10. It will be appreciated that the can end shell 10 may be directly or indirectly transferred from the coining tool assembly to the reforming tool assembly. For example, the coining tool assembly and reforming tool assembly may be employed at different stages in a can end forming process, a non-limiting example of which is depicted in FIGS. 9-16A, and additional formation steps may be performed between coining the can end shell 10 and reforming the can end shell 10.

The reforming tool assembly includes a reforming tool 60 and a reforming support assembly including an upper reforming support tool 70 and a lower reforming support tool 80. While two upper tools and one lower tool are illustrated in FIG. 4, it is contemplated that any number of tools may be employed without departing from the scope of the disclosed concept. For example and without limitation, the reforming tool 60 and the upper reforming support tool 70 may be combined into a single tool or split into any number of tools. Similarly, the lower reforming support tool 80 may be split into any number of tools.

The reforming tool 60 includes a reforming section 61 that, when pressed against the chamfer 13 during the reforming operation shown in FIG. 4, causes a step 19 (see FIG. 5) to be formed in the chamfer 13 of the can end shell 10.

The reforming tool 60 also includes a second elongated portion 62. The second elongated portion 62 is structured to be seated in the countersink 16 during the reforming operation. In some embodiments the second elongated portion 62, like the first elongated portion 32 of the coining tool 30, may also be used to reform the can end shell 10, for example and without limitation, to deepen the countersink 16 and/or modify the shape of the panel wall 15 and/or chuckwall 17, for example by making them substantially vertical.

The upper reforming support tool 70 and the lower reforming support tool 80 support the can end shell 10 when the step 19 is being formed. To this end, the upper reforming tool 70 includes a third flat portion 71 and the lower reforming tool 80 includes a first step section 81 and a second step section 82. The first step section 81 supports a lower end of the chamfer 13 and the second step section 82 supports an upper end of the chamfer 13 during the reforming operation shown in FIG. 4.

The formation of the step 19 in the chamfer 13 utilizes excess or loose metal which may have been produced when the can end shell 10 was coined as shown in FIG. 2, and places the metal in the central panel portion 11 substantially in tension. The utilization of the excess or loose metal reduces buckling tendencies of the can end shell 10 and reduces the tendency of the central panel portion 11 to bulge or dome upwardly due to internal pressure of the container. Reducing the tendency of the can end shell 10 to buckle or dome allows the thickness or gauge of the material used to make the can end shell 10 to be reduced.

Figure 6:
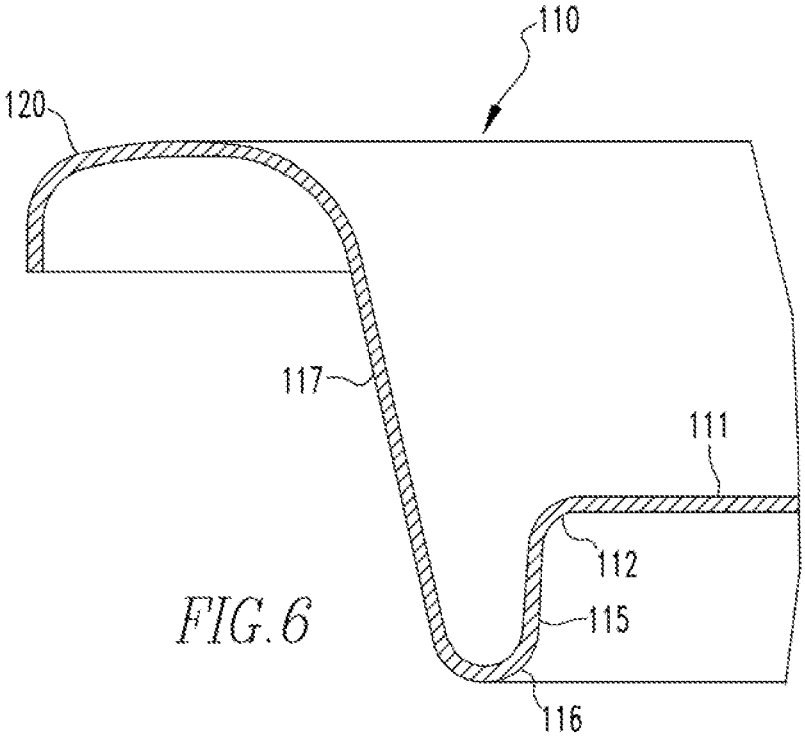
FIGS. 6 and 7 are enlarged side section views of a portion of another can end shell prior to being reformed in accordance with an embodiment of the disclosed concept.
Figure 7:
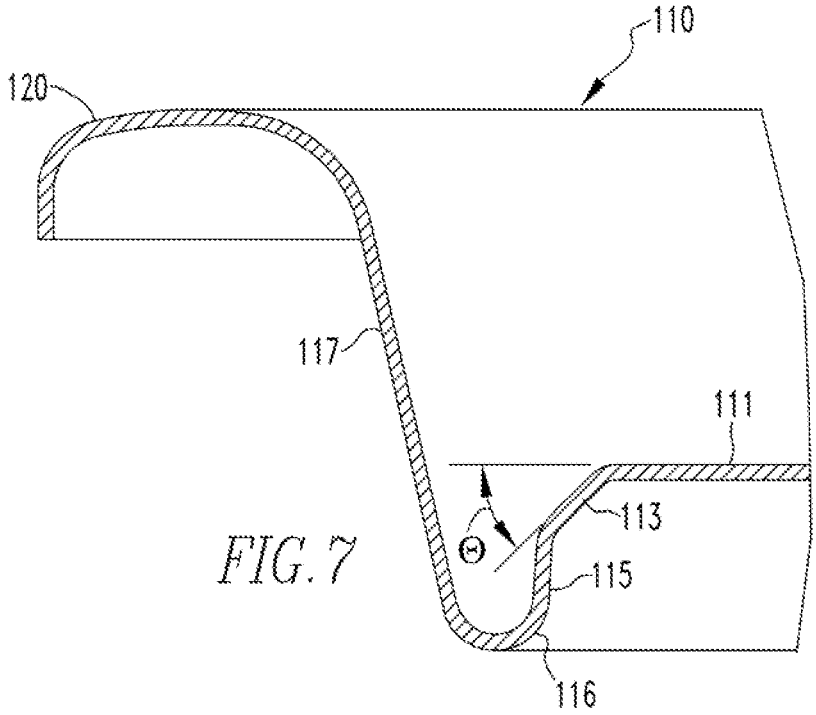
Figure 8:
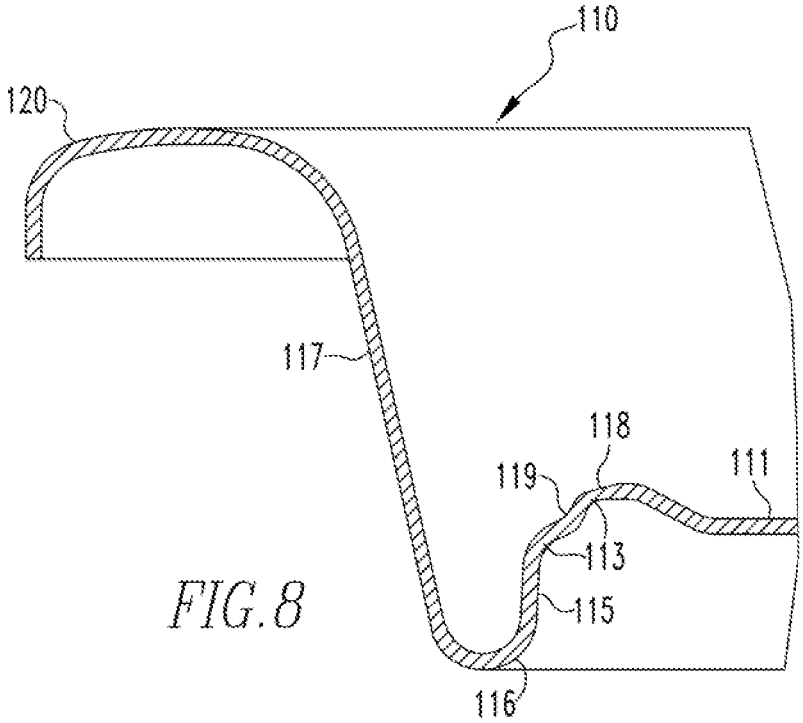
FIG. 8 is an enlarged side section view of a portion of the other can end shell after it has been reformed in accordance with an embodiment of the disclosed concept.

It will be appreciated that the coining and reforming processes depicted in FIGS. 2 and 4 are not limited to the can end shell 10 depicted in FIG. 1, but rather may be applied to other geometries of can end shells. For example, FIGS. 6-8 illustrate another example of a can end shell 110 that is coined and reformed. While the can end shell 110 also includes a central panel portion 111, a panel radius 112, a panel wall 115, a countersink 116, a chuckwall 117, and a curved flange 120, their geometries differ from corresponding parts of the can end shell 10 depicted in FIG. 1. Another difference between the can end shells 10 and 110 is that the can end shell 110 does not initially include a chamfer. However, as shown in FIG. 7, a process may be performed to form a chamfer 113 in or around the panel radius 112 of the can end shell 110. Similar to the can end shell 10, the chamfer 113 of the can end shell 110 is formed at an angle θ with respect to the central panel portion 111. In one non-limiting embodiment, the angle θ is about 45°. In another non-limiting embodiment, the angle θ is within a range of about 30° to about 60°. However, it is appreciated that the angle θ can have any value without departing from the scope of the disclosed concept. Coining and reforming processes similar to those depicted in FIGS. 2 and 4 may then be performed on the can end shell 110 to form a coined section 118 and a step section 119, as depicted in FIG. 8.

It will be appreciated that the can end shells 10 and 110 depicted in FIGS. 1 and 6 are provided solely for purposes of illustration in accordance with two non-limiting embodiments of the disclosed concept. It will be further appreciated that the aforementioned coining and reforming processes may be applied to a variety of can end shell geometries without departing from the scope of the disclosed concept.

Figure 9:
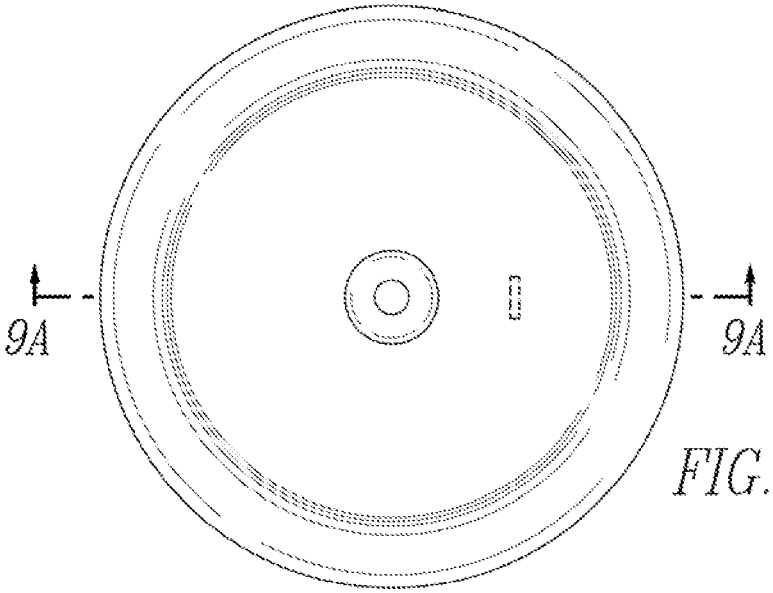
FIGS. 9-16A illustrate can end formation steps in accordance with one embodiment of the disclosed concept.
Figure 9A:
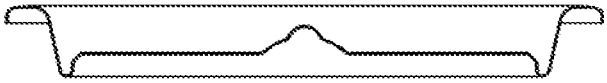
Figure 10:
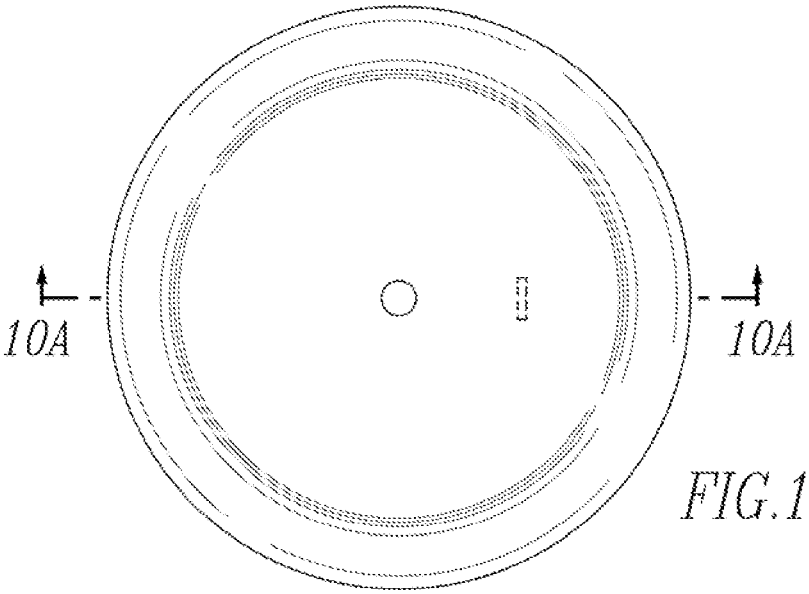
Figure 10A:
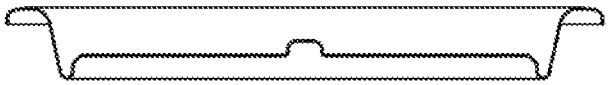
Figure 11:
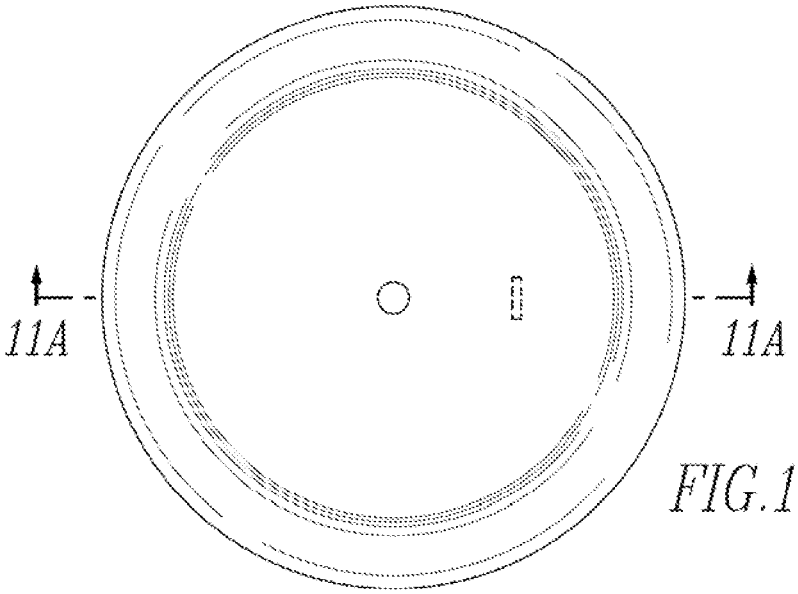
Figure 11A:
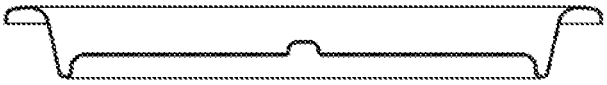
Figure 12:
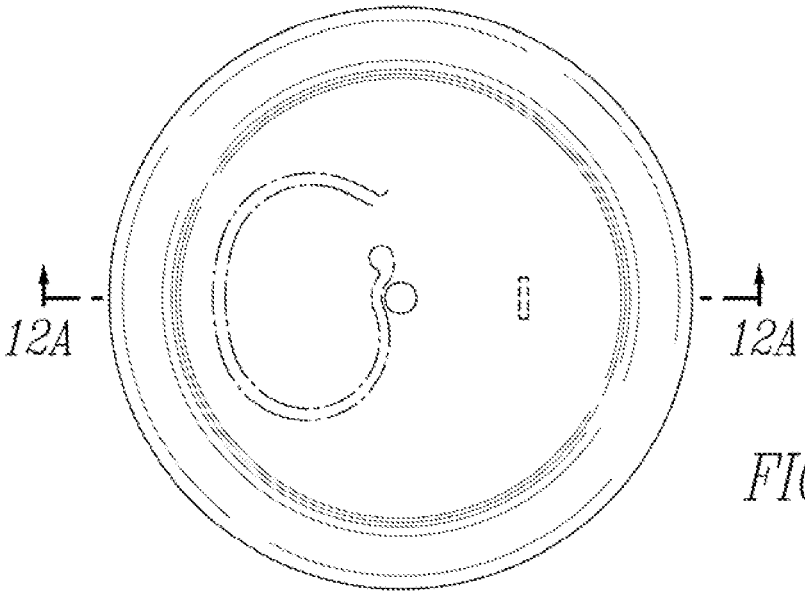
Figure 12A:
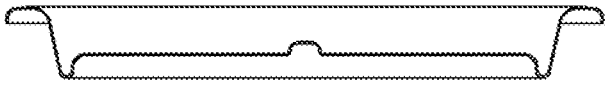
Figure 13:
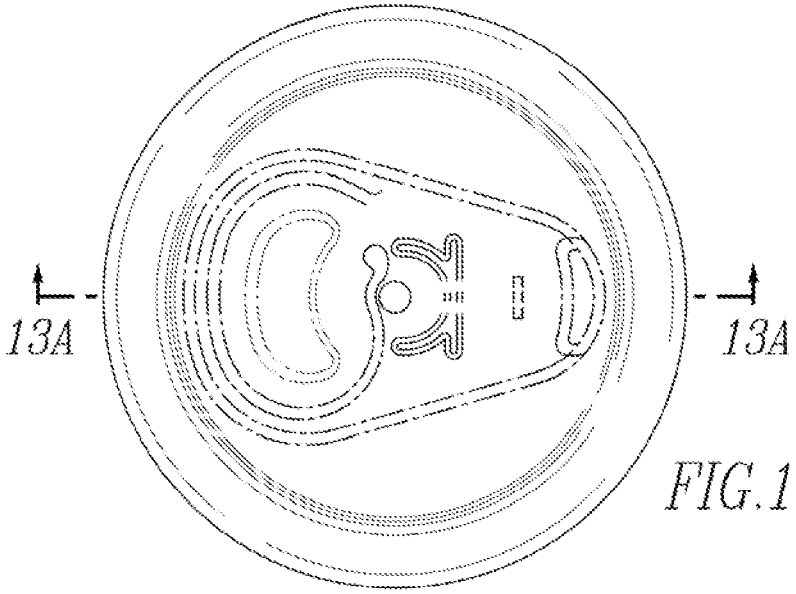
Figure 13A:
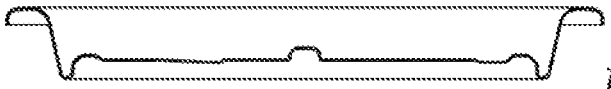
Figure 14:
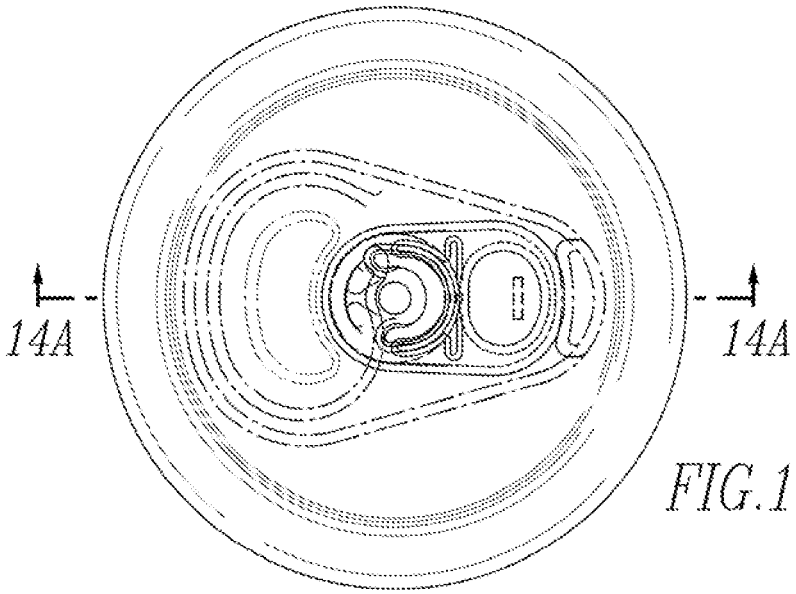
Figure 14A:
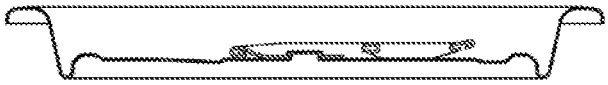
Figure 15:
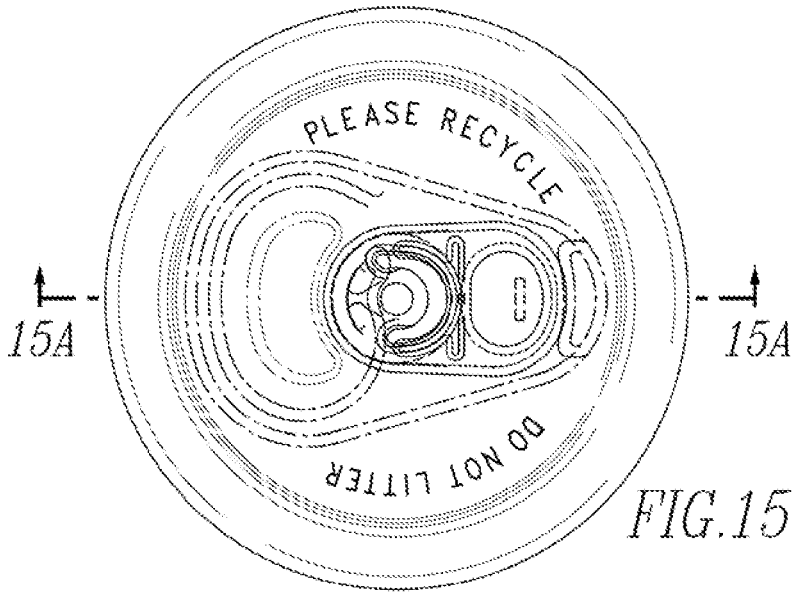
Figure 15A:
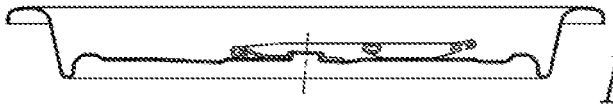
Figure 16:
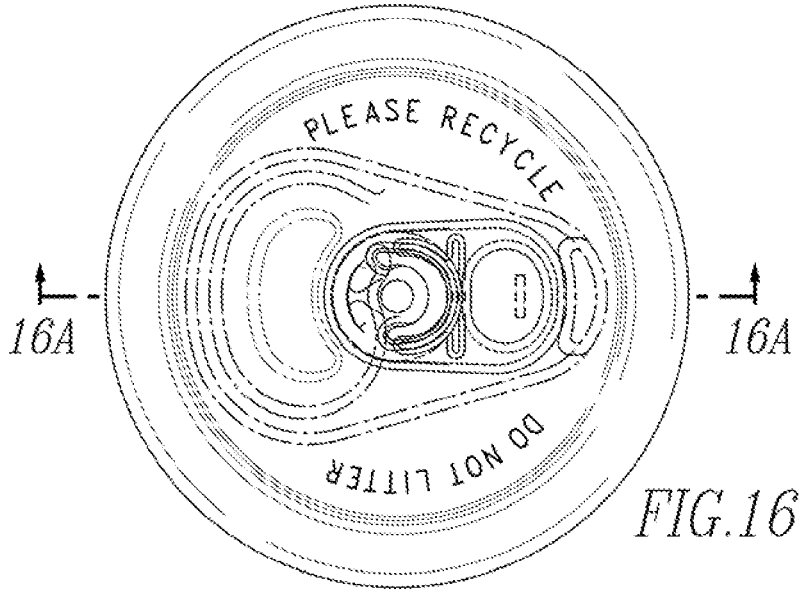
Figure 16A:
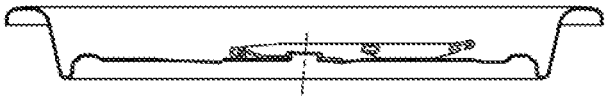

In accordance with the disclosed concept, formation of a can end generally involves a process of up to eight or more formation steps, a non-limiting example of which is depicted in FIGS. 9-16A. Specifically, FIGS. 9 and 9A illustrate a bubble form, which may occur in a first tooling station. FIGS. 10 and 10A illustrate a first rivet form, which may be performed in a second tooling station. FIGS. 11 and 11A illustrate a seconding rivet form and a coining process, which may be performed in a third tooling station. FIGS. 12 and 12A illustrate a formation of a scoreline, which may be performed in a fourth tooling station. FIGS. 13 and 13A illustrate a panel formation, which may be performed in a fifth tooling station. FIGS. 14 and 14A illustrate a stake process, which may be performed in a sixth tooling station. FIGS. 15 and 15A illustrate a rivet restrike and lettering process, which may be performed in a seventh tooling station. FIGS. 16 and 16A illustrate a tab ear wipedown and knock down process which may be performed in an eighth tooling station.

In one non-limiting embodiment, a coining process depicted for example in FIG. 2 can be performed by the third tooling station and a reforming process depicted for example in FIG. 5 can be performed by the seventh or eighth tooling stations. However, it will be appreciated that the coining process depicted for example in FIG. 2 and the reforming process depicted for example in FIG. 5 can be performed by other tooling stations without departing from the scope of the disclosed concept. Again, it will be appreciated that the aforementioned forming steps and processes, as well as the corresponding tooling stations, are provided solely for purposes of illustration in accordance with one non-limiting embodiment of the disclosed concept.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A tool assembly to reform a can end shell having a central panel portion, a first panel radius around the central panel portion, a chamfer extending from the first panel radius, a second panel radius around the chamfer, a panel wall extending from the second panel radius, a countersink formed at the end of the panel wall, and a chuckwall extending upwardly from the countersink, the tooling assembly comprising:

a coining tool assembly including:

a coining tool having an angled section structured to form a coined section in the first panel radius around at least a portion of the circumference of the central panel portion during a coining operation; and a reforming tool assembly including:

a reforming tool having a reforming section structured to form a step in the chamfer during a reforming operation and a first elongated portion structured to be seated in the countersink; and a reforming support assembly structured to support the can end shell during the reforming operation and to form a raised portion in the central panel portion adjacent to the first panel radius during the reforming operation, wherein the reforming support assembly further includes a lower reforming support tool having a first step structured to support a lower end of the chamfer and a second step structured to support an upper end of the chamfer, wherein the reforming support assembly further includes an upper reforming support tool structured to be disposed beside the reforming tool and including a flat portion structured to abut against a portion of the can end shell opposite of the second step of the lower reforming support tool.

2. The tool assembly of claim 1, wherein the angled section of the coining tool is structured to form the coined section in the first panel radius around the entire circumference of the central panel portion.

3. The tool assembly of claim 1, wherein the coining tool assembly further includes a coining support assembly structured to support the can end shell during the coining operation.

4. The tool assembly of claim 3, wherein the coining support assembly includes a planar portion corresponding to the central panel portion and an angled portion extending from the planar portion, wherein a length of the angled portion is substantially equal to a distance between the first panel radius and the second panel radius.

5. The tool assembly of claim 1, wherein coining tool further includes a second elongated portion structured to be seated in the countersink.

6. The tool assembly of claim 5, wherein the elongated portion of the coining tool is further structured to at least one of: deepen the countersink; modify the shape of the panel wall; and modify the shape of the chuckwall.

7. The tool assembly of claim 1, wherein the elongated portion of the reforming tool is further structured to at least one of: deepen the countersink; modify the shape of the panel wall; and modify the shape of the chuckwall.

8. The tool assembly of claim 1, wherein the lower reforming support tool includes a body portion and a stepped portion, wherein the stepped portion extends upward from the body portion and includes the first step and the second step.

9. The tool assembly of claim 1, wherein the reforming tool including the reforming section and the first elongated portion is a unitary piece.

10. A tool assembly to reform a can end shell having a central panel portion, a first panel radius around the central panel portion, a chamfer extending from the first panel radius, a second panel radius around the chamfer, a panel wall extending from the second panel radius, a countersink formed at the end of the panel wall, and a chuckwall extending upwardly from the countersink, the tooling assembly comprising:

a coining tool assembly including:

a coining tool having an angled section structured to form a coined section in the first panel radius around at least a portion of the circumference of the central panel portion during a coining operation; and a reforming tool assembly including:

a reforming tool having a reforming section structured to form a step in the chamfer during a reforming operation and a first elongated portion structured to be seated in the countersink; and a reforming support assembly structured to support the can end shell during the reforming operation and to form a raised portion in the central panel portion adjacent to the first panel radius during the reforming operation, wherein the reforming support assembly further includes a lower reforming support tool having a first step structured to support a lower end of the chamfer and a second step structured to support an upper end of the chamfer, wherein the lower reforming support tool includes a body portion and a stepped portion, wherein the stepped portion extends upward from the body portion and includes the first step and the second step, wherein the second step extends further from the body portion than the first step.

11. A tool assembly to reform a can end shell having a central panel portion, a first panel radius around the central panel portion, a chamfer extending from the first panel radius, a second panel radius around the chamfer, a panel wall extending from the second panel radius, a countersink formed at the end of the panel wall, and a chuckwall extending upwardly from the countersink, the tooling assembly comprising:

a coining tool assembly including:

a coining tool having an angled section structured to form a coined section in the first panel radius around at least a portion of the circumference of the central panel portion during a coining operation; and a reforming tool assembly including:

a reforming tool having a reforming section structured to form a step in the chamfer during a reforming operation and a first elongated portion structured to be seated in the countersink; and a reforming support assembly structured to support the can end shell during the reforming operation and to form a raised portion in the central panel portion adjacent to the first panel radius during the reforming operation, wherein the coining tool assembly further includes a coining support assembly structured to support the can end shell during the coining operation, wherein the coining support assembly includes an upper coining support tool and a lower coining support tool, wherein the upper coining support tool is structured to be disposed beside the coining tool, wherein the upper coining support tool includes a first planar portion and the lower coining support tool includes a second planar portion, and wherein the first planar portion is structured to abut against a portion of the central panel portion opposite the second planar portion.

* * * * *